US009482081B2

(12) United States Patent
Pimenov et al.

(10) Patent No.: US 9,482,081 B2
(45) Date of Patent: Nov. 1, 2016

(54) METHOD FOR PREHEATING AN OIL-SATURATED FORMATION

(75) Inventors: Vyacheslav Pavlovich Pimenov, Moscow (RU); Denis Vladimirovich Klemin, Moscow (RU)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 679 days.

(21) Appl. No.: 13/816,175

(22) PCT Filed: Aug. 23, 2010

(86) PCT No.: PCT/RU2010/000456
§ 371 (c)(1),
(2), (4) Date: Apr. 22, 2013

(87) PCT Pub. No.: WO2012/026837
PCT Pub. Date: Mar. 1, 2012

(65) Prior Publication Data
US 2013/0206399 A1 Aug. 15, 2013

(51) Int. Cl.
*E21B 43/24* (2006.01)
*E21B 47/06* (2012.01)

(52) U.S. Cl.
CPC ..... *E21B 43/2406* (2013.01); *E21B 43/24* (2013.01); *E21B 47/065* (2013.01)

(58) Field of Classification Search
CPC ... E21B 43/2406; E21B 47/065; E21B 43/24
See application file for complete search history.

(56) References Cited

U.S. PATENT DOCUMENTS 3,774,684 A * 11/1973 Allen et al. ..... 166/303
4,026,358 A * 5/1977 Allen ..... 166/261
4,068,715 A * 1/1978 Wu ..... 166/250.15
4,085,803 A 4/1978 Butler
4,099,570 A 7/1978 Vandergrift
4,116,275 A 9/1978 Butler et al.
4,344,485 A 8/1982 Butler (Continued)

FOREIGN PATENT DOCUMENTS

RU 2353767 C2 * 4/2009
WO 2010062208 6/2010
WO WO 2010062208 A1 * 6/2010 ..... E21B 43/2406

OTHER PUBLICATIONS

International Search Report of PCT Application No. PCT/RU2010/000456 dated May 12, 2011: p. 1.

(Continued)

*Primary Examiner* — Angela M DiTrani
*Assistant Examiner* — Crystal J Miller

(57) ABSTRACT

Method for preheating an oil reservoir comprises injecting saturated or superheated steam at an initial injection pressure into a tubing placed inside a well drilled in the oil reservoir. Steam temperature at an outlet of the tubing is measured and a heat flow from the well to the oil reservoir is calculated. An optimal steam injection rate when steam quality of the injected steam at the tubing outlet becomes greater than zero, is calculated, the optimal steam injection rate ensuring compensation of the heat flow from the well to the oil reservoir with the heat of steam condensation. A steam injection rate is decreased to the calculated optimal steam injection rate value by decreasing the initial injection pressure providing constant temperature at the outlet of the tubing.

7 Claims, 1 Drawing Sheet

(56) References Cited

U.S. PATENT DOCUMENTS

| | | | | |
|---|---|---|---|---|
| 4,468,135 | A * | 8/1984 | McCain et al. | 374/44 |
| 4,727,489 | A * | 2/1988 | Frazier et al. | 702/13 |
| 4,860,827 | A * | 8/1989 | Lee et al. | 166/261 |
| 5,020,596 | A * | 6/1991 | Hemsath | 166/272.3 |
| 5,215,146 | A | 6/1993 | Sanchez | |
| 5,415,037 | A * | 5/1995 | Griston et al. | 73/152.12 |
| 6,032,539 | A * | 3/2000 | Liu | G01F 1/74 73/861.04 |
| 6,988,549 | B1 | 1/2006 | Babcock | |
| 7,013,740 | B2 * | 3/2006 | Dutton et al. | 73/861.354 |
| 7,231,835 | B2 * | 6/2007 | Dutton et al. | 73/861.354 |
| 7,334,637 | B2 * | 2/2008 | Smith, Jr. | 166/288 |
| 7,694,736 | B2 * | 4/2010 | Betzer Tsilevich | 166/272.3 |
| 7,699,104 | B2 * | 4/2010 | Tsilevich | 166/272.3 |
| 8,167,041 | B2 * | 5/2012 | Chiesa et al. | 166/267 |
| 8,596,357 | B2 * | 12/2013 | Nenniger | 166/272.1 |
| 8,701,773 | B2 * | 4/2014 | O'Donnell et al. | 166/303 |
| 8,756,019 | B2 * | 6/2014 | Pimenov et al. | 702/12 |
| 8,863,839 | B2 * | 10/2014 | Kaminsky et al. | 166/302 |
| 2004/0221660 | A1 * | 11/2004 | Dutton et al. | 73/861.354 |
| 2005/0149264 | A1 * | 7/2005 | Tarvin et al. | 702/6 |
| 2006/0123923 | A1 * | 6/2006 | Dutton et al. | 73/861.354 |
| 2006/0185843 | A1 * | 8/2006 | Smith, Jr. | 166/250.01 |
| 2006/0191684 | A1 * | 8/2006 | Smith, Jr. | 166/250.1 |
| 2008/0289821 | A1 * | 11/2008 | Betzer Tsilevich | 166/272.3 |
| 2008/0289822 | A1 * | 11/2008 | Betzer Tsilevich | 166/272.3 |
| 2009/0173494 | A1 * | 7/2009 | Tarvin | E21B 47/065 166/250.15 |
| 2010/0000733 | A1 * | 1/2010 | Chiesa et al. | 166/272.6 |
| 2010/0163229 | A1 * | 7/2010 | Nenniger | 166/272.3 |
| 2011/0146982 | A1 * | 6/2011 | Kaminsky | E21B 43/24 166/272.2 |
| 2011/0288778 | A1 * | 11/2011 | Pavlovich et al. | 702/12 |
| 2013/0112394 | A1 * | 5/2013 | O'Donnell et al. | 166/57 |

OTHER PUBLICATIONS

Chalifoux et al., "Reservoir Monitoring Methods and Installation Practices," Canadian Association of Drilling Engineers Newsletter, 2007: pp. 1-8.

Shin et al., "SPE 95754: Optimizing the SAGD Process in Three Major Canadian Oll-Sands Areas," SPE International, 2005: pp. 1-11.

Vanegas Prada et al., "SPE/PS-CIM/CHOA 97918: Impact of Operational Parameters and Reservoir Variables During the Setup Phase of a SAGD Process," SPE International, 2005: pp. 1-7.

Vincent et al., "SPE 86970: Developing SAGD Operating Strategy using a Coupled Wellbore Thermal Reservoir Stimulator," SPE International, 2004: pp. 1-8.

* cited by examiner

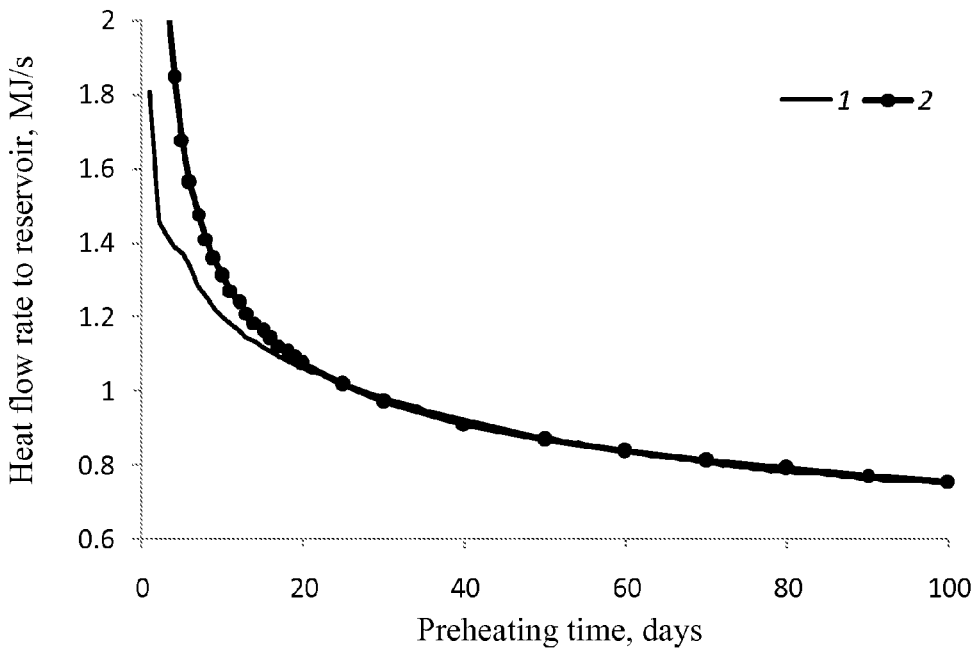
Heat flow rate to reservoir, MJ/s
2
1.8
1.6
1.4
1.2
1
0.8
0.6
0
20
40
60
80
100
Preheating time, days
1
2

METHOD FOR PREHEATING AN OIL-SATURATED FORMATION

CROSS-REFERENCE TO RELATED APPLICATION

This application is a U.S. National Stage Application under 35 U.S.C. §371 and claims priority to PCT Application Number PCT/RU2010/000456 filed Aug. 23, 2010, which is incorporated herein by reference in its entirety.

FIELD OF THE DISCLOSURE

The invention is related to oil and gas industry and could be applicable to various thermal methods of heavy oil recovery in particular to the Steam Assisted Gravity Drainage (SAGD), huff and puff, cyclic steam injection, etc.

BACKGROUND OF THE DISCLOSURE

Heavy oil and bitumen account for more than double the resources of conventional oil in the world. Recovery of heavy oil and bitumen is a complex process requiring products and services built for specific conditions, because these fluids are extremely viscous at reservoir conditions (up to 1500000 cp). Heavy oil and bitumen viscosity decreases significantly with temperature increases and thermal recovery methods seems to be the most promising ones. Steam Assisted Gravity Drainage (SAGD) offers a number of advantages in comparison with other thermal recovery methods. Typical implementation of this method requires at least one pair of parallel horizontal wells drilled near the bottom of the reservoir one above the other. The upper well, "injector," is used for steam injection, the lower well, "producer," is used for production of the oil. SAGD provides greater production rates, better reservoir recoveries, and reduced water treating costs and dramatic reductions in Steam to Oil Ratio (SOR).

One of main problems of thermal recovery methods is the processes start-up. Due to high viscosity the cold oil is essentially immobile and therefore initial reservoir heating is required. This initial preheating stage is necessary to create a uniform thermo-hydraulic communication between the well pair, or create a heated zone around the well in the case of single well completion. During this start-up period, steam circulated in well(-s) to heat the reservoir and no (or little) oil production is assumed. This stage requires a lot of energy to be injected into the reservoir with the steam. Preheating stage strategy aims at minimizing the time in which well(-s) can be converted to the oil production operation regime as well as minimization of the amount of steam needed for circulation.

Thermal methods of heavy oil recovery are described in U.S. Pat. No. 4,085,803, published Apr. 25, 1978, U.S. Pat. No. 4,099,570 published Jul. 11, 1978 and in U.S. Pat. No. 4,116,275 published Sep. 26, 1978. Description of the SAGD process and its modifications is given in U.S. Pat. No. 4,344,485 published Aug. 17, 1982.

U.S. Pat. No. 6,988,549 published Jan. 24, 2006 discusses certain problems associated with typical SAGD projects. According to this patent the economics of such projects is significantly impacted by the cost associated with steam generation and SAGD does not typically employ the use of super-saturated steam because of the high cost of producing this steam with conventional hydrocarbon-fired tube boilers which results in using steam that is less efficient in transferring heat to the heavy oil reservoir.

The economics of SAGD may have been adversely affected by the duration of the preheating stage and the circulation steam rates at this stage. Commercial simulator numerical models were used to estimate SAGD preheating parameters (steam circulation rate and preheating stage duration). In particular: Vanegas Prada J. W., Cunha L. B., Alhanati F. J. S.: "Impact of Operational Parameters and Reservoir Variables During the Startup Phase of a SAGD Process," SPE paper 97918; Vincent K. D., MacKinnon C. J., Palmgren C. T. S.: "Developing SAGD Operating Strategy using a Coupled Wellbore Thermal Reservoir Simulator," SPE paper 86970; Shin H., Polikar M.: "Optimizing the SAGD Process in Three Major Canadian Oil-Sands Areas," SPE paper 95754.

Nevertheless these models cannot be used for the fast estimation of the optimal preheating parameters for a wide range of reservoir properties and do not consider necessary changes of the well operating regimes at various time intervals of the preheating stage.

U.S. Pat. No. 5,215,146 published Jul. 1, 1993 describes one of the realizations of preheating process. Method given in this patent can reduce the duration of the preheating stage. In the described process steam is circulated in both horizontal wells with the constant considerable temperature gradient in-between them, which forces the heated fluids to move from upper to lower well. Certain amount of foam is injected in order to increase pressure gradient between the wells and hence the oil phase velocities. Increased oil rates will decrease preheating time but only after the time moment when thermo-hydraulic communication between well pair was achieved. This method is energy- and capital-expensive, as foam production requires additional resources and equipment. Associated oil/water/foam production control procedure is also too complex.

SUMMARY OF THE DISCLOSURE

The claimed method allows to optimize preheating stage and reduce resource—, capital and energy costs. A saturated or a superheated steam is injected at an initial injection pressure into a tubing placed inside a well drilled in an oil reservoir. The steam temperature is measured at an outlet of the tubing and a heat flow from the well to the reservoir is calculated. Then, an optimal steam injection rate, when steam quality of the injected steam at the tubing outlet becomes greater than zero, is calculated, the optimal steam injection rate ensures compensation of the heat flow from the well to the oil-bearing formation with the heat of steam condensation. The steam injection rate is decreased to the calculated optimal steam injection rate value by decreasing the initial pressure providing constant temperature at the outlet of the tubing.

The saturated steam could be water based. The steam temperature at the outlet of the tubing can be measured constantly and continuously or periodically.

Additionally, a steam pressure can be measured at the outlet of the tubing.

The heat flow from well to the oil reservoir can be calculated by formulae:

$$Q(t) = C_1 \cdot \frac{4\pi \cdot \lambda \cdot \Delta T \cdot z_{hor}}{\ln\left(\frac{a \cdot t}{r_w^2}\right)}$$

where π is mathematical constant approximately equal to 3,14159, λ and a—thermal conductivity and thermal diffusivity of the oil reservoir, ΔT—difference between a temperature of a wall of the well determined from the measured steam temperature and the oil reservoir temperature, $z_{hor}$—a length of a horizontal part of the well, t—a preheating time, $r_w$—well radius, $C_1$—constant value approximately equal to 1.

At the start of the preheating process it is preferable to set the initial injection pressure to the maximum possible value.

BRIEF DESCRIPTION OF THE FIGURES

The claimed invention is illustrated by FIG. 1 where heat flow rate to the reservoir, MJ/s, is shown, and by Table 1 showing temperature between wells, ° C.

DETAILED DESCRIPTION

According to the method a temperature is measured in a well drilled in an oil reservoir. Temperature data is used for estimation of a saturated steam temperature in the well. The heat flow from the well to the reservoir is calculated by an analytical formula using the measured steam temperature and reservoir thermal properties. A steam rate needed for an optimal operation regime is calculated on the basis of the energy balance. An optimal preheating time can be calculated by an analytical formula using reservoir thermal properties.

Presented workflow provides information on the steam rate needed for efficient and cost-effective SAGD preheating and optimal duration of the preheating with the respect to the reservoir thermal properties.

Main parameters of this model are: reservoir thermal conductivity and volumetric heat capacity, specific heat of steam condensation, steam quality, water density, difference between steam and reservoir temperature, well radius and length.

At the initial stage (1-7 days, depending on reservoir thermal properties) the rate of steam injection and hence an initial steam injection pressure are supposed to be as high as possible. A saturated or a superheated steam can be used.

At this stage due to the limitations of the well completion steam flow rate is lower than needed for optimal regime: achievable steam circulation rates often cannot compensate the heat flow from the well to the reservoir with the heat of the condensation as the reservoir is not heated. All this leads to the steam condensation in the tubing.

In order to control the preheating process Distributed Temperature Sensors (DTS) or ordinary sensors could be installed along the well. Temperature measurements can be carried out continuously or periodically. Time periods between measurements could depend on oil viscosity, reservoir properties, duration of the preheating and could vary from 1 to 10 times per day. At least one temperature sensor at an outlet of the tubing allows maintaining approximately constant steam temperature in the annulus in order to keep the same efficiency of the reservoir heating.

At the time moment when steam finally reaches the tubing outlet its saturation temperature will correspond to the particular saturation pressure at each point of the well. In one of the embodiments of the disclosed method steam state control could be done using additionally installed pressure sensors at the tubing outlet, example of applicable pressure sensor is listed in (Chalifoux G. V., Taylor R. M. Reservoir Monitoring Methods and Installation Practices//Canadian Association of Drilling Engineers newsletter, 2007, N.2. P. 2-5).

For the estimation of the heat flow from the well surface to the reservoir different numerical and analytical solutions could be used, in particular the analytical estimation of the heat flow from the cylindrical well surface to the reservoir. A temperature of a well wall can be determined using the measured temperature of saturated steam. The heat flow from well to the oil reservoir can be calculated by formulae:

$$Q(t) = C_1 \cdot \frac{4\pi \cdot \lambda \cdot \Delta T \cdot z_{hor}}{\ln\left(\frac{a \cdot t}{r_w^2}\right)} \tag{1}$$

where π is mathematical constant approximately equal to 3,14159, λ and a—thermal conductivity and thermal diffusivity of formation, ΔT—difference between the well wall temperature and a reservoir temperature, $z_{hor}$—well horizontal section length, t—a preheating time, $r_w$—well radius, $C_1$—constant value approximately equal to 1.

FIG. 1 show comparison between an analytical model and results of numerical modeling of heat flow rate from the well to the reservoir Q(t) for $C_1$=1.4, where 1—Numerical modeling, 2—Analytical model (λ=3 W/(m·K), Cp.=1900 kJ/($m^3$·K)).

In order to provide effective heating of the reservoir it is crucial to maintain sufficient amount of steam providing heat flow Q(t) (1). Heat is mainly delivered to the reservoir with the heat of steam condensation. Using the difference between steam quality values at the tubing inlet and annulus outlet (value at the outlet must be greater than zero and fixed at the relatively small value≈0.1) one can calculate steam rate W(t) needed for the optimal operation regime.

$$W(t) = \frac{Q(t)}{L \cdot \Delta\chi}, \tag{2}$$

where L is a specific heat of steam condensation, $\Delta X = X_0 - X_1$, $X_0$—steam quality at the tubing inlet, $X_1$—steam quality at the annulus outlet ($X_1$>0).

Thus as shown in (2) the optimal steam injection rate in time (after the steam quality at the annulus start to be greater than zero) should be determined by the condition that the heat flow from the well to the reservoir is compensated with the heat of steam condensation.

In the process of the reservoir preheating the heat flow rate from the well to the reservoir is decreasing in time as shown in FIG. 1. Therefore it is possible to gradually reduce steam injection rates while keeping the same temperature at the tubing outlet and hence the same process efficiency and minimizing the amount of steam needed for circulation. Steam injection rates can be changed by changing the injection pressure provided that the temperature at the tubing outlet remains the same. Decrease of the steam injection pressures will result in decrease of the steam injection rates which will then result in the preheating process optimization as claimed.

Optimal preheating duration can be determined using the analytical formula which depends on the reservoir thermal properties:

$$t_{preh} \approx C_2 \cdot \frac{h^2}{\lambda} \cdot C_p, \quad (3)$$

where h—half of a distance between wells, $C_p$—reservoir volumetric heat capacity, $C_2$—dimensionless constant≈1, dependent on the chosen preheating temperature in the end of preheating process. $C_2$ depends on the initial reservoir temperature and temperature between wells required to obtain oil mobility in interwell region. Time needed to preheat area between wells up to the temperature, for example, T=80 deg C. was calculated numerically and analytically using formula (3) (with $C_2$=1.1) as presented in Table 1 (set of parameters described in the Example section).

TABLE 1

| Thermal conductivity, W/(m · K) | Volumetric heat capacity, kJ/(m³ · K) | Preheating time, days Numerical model | Preheating time, days Analytical model |
|---|---|---|---|
| 1.5 | 1600 | 100 | 97 |
| 2.5 | 1700 | 69 | 70 |
| 3 | 1900 | 61 | 57 |
| 4 | 2250 | 53 | 51 |
| 5 | 2500 | 46 | 45 |

The claimed method was implemented using commercial reservoir simulator with the following set of parameters (representing one of the Atabacka tar sands heavy oil fields):

Initial reservoir pressure=10 bar, initial reservoir temperature=5° C., steam quality at the inlet=0.8, reservoir thermal conductivity=3 W/m/K, overburden formation thermal conductivity=2.1 W/(m·K), reservoir volumetric heat capacity=1900.0 kJ/(m³·C), overburden formation volumetric heat capacity=2500 kJ/(m³·C), initial oil saturation=0.76, residual oil saturation=0.127, oil viscosity at reservoir conditions 1600 Pa·s, oil viscosity at steam temperature 0.015 Pa·s.

Injection well parameters: length of horizontal section 500 m, the values of internal diameter (ID) and outer diameter (OD) of the annulus and tubing: ID tubing 3", OD tubing 3.5", ID casing 8.625", OD casing 9.5". The heat capacity of tubing/casing is 1.5 kJ/kg/K. Thermal conductivity of tubing/casing is 45 W/m/K, the wellbore wall effective roughness 0.001 m.

Optimal preheating duration was determined using the analytical formulae (3). For presented parameters preheating time was 60 days. During the whole simulation process temperature at the tubing outlet was constantly measured. Duration of the initial stage of the preheating process was 5 days. After that time steam temperature at the tubing outlet reached 180° C. Steam pressure value corresponded to this temperature was equal to 1.0 MPa. After the initial stage optimal steam injection rate W(t) was estimated using (2) and supported by the gradual decrease of the steam injection pressure. The claimed method allowed reducing total steam consumption by more than 50%.

The invention claimed is:

1. A method for preheating an oil reservoir, the method comprising:

injecting a saturated or a superheated steam at an initial injection pressure during an initial preheating stage of a steam assisted gravity drainage (SAGD) process, wherein the steam is injected into a tubing disposed within a well traversing the oil reservoir, measuring temperature at an outlet of the tubing during the initial preheating stage of the steam assisted gravity drainage process, the temperature is measured by at least one temperature sensor installed at the outlet of the tubing, calculating a heat flow from the well to the oil reservoir using the temperature measured at the outlet of the tubing during the preheating initial stage of the steam assisted gravity drainage process and reservoir thermal properties, calculating an optimal steam injection rate corresponding to a moment when steam quality of the injected steam at the tubing outlet becomes greater than zero, wherein the optimal steam infection rate W(t) is calculated according to:

$$W(t) = \frac{Q(t)}{L \cdot \Delta\chi},$$

where Q(t) is the calculated heat flow from the well to the oil reservoir, L is a specific heat of steam condensation, $\Delta X = X_0 - X_1$, $X_0$ is steam quality at an inlet of the tubing, and $X_1$ is steam quality at the outlet of the tubing, and decreasing a steam injection rate to the calculated optimal steam injection rate value by decreasing the initial injection pressure to a value providing the calculated optimal steam injection rate value and constant temperature at the outlet of the tubing.

2. The method of claim 1 wherein the saturated or the superheated steam is water steam.

3. The method of claim 1 wherein the temperature at the outlet of the tubing is measured constantly and continuously.

4. The method of claim 1 wherein the temperature at the outlet of the tubing is measured periodically.

5. The method of claim 1 wherein a steam pressure is measured by a pressure sensor installed at the outlet of the tubing.

6. The method of claim 1 wherein the heat flow from the well to the oil reservoir Q(t) is calculated by formulae:

$$Q(t) = C_1 \cdot \frac{4\pi \cdot \lambda \cdot \Delta T \cdot z_{hor}}{\ln\left(\frac{a \cdot t}{r_w^2}\right)}$$

where π is a mathematical constant approximately equal to 3.14159, λ is thermal conductivity of the oil reservoir, a is thermal diffusivity of the oil reservoir, ΔT is a difference between a temperature of the well determined from the measured temperature at the outlet of the tubing and the oil reservoir temperature, $z_{hor}$ is a length of a horizontal part of the well, t is a preheating time, $r_w$ is a well radius, and $C_1$ is a constant value approximately equal to 1.

7. The method of claim 1 wherein the saturated or the superheated steam is injected at the maximum initial pressure.

* * * * *